US010088180B2

(12) United States Patent
Lundgreen et al.

(10) Patent No.: US 10,088,180 B2
(45) Date of Patent: Oct. 2, 2018

(54) STEAM DISPERSION SYSTEM

(71) Applicant: DRI-STEEM Corporation, Eden Prairie, MN (US)

(72) Inventors: James Michael Lundgreen, Lakeville, MN (US); David Michael Baird, Bloomington, MN (US); Joseph T. Haag, Delano, MN (US); Mark Allen Kirkwold, Shakopee, MN (US)

(73) Assignee: DRI-STEEM Corporation, Eden Prairie, MN (US)

( * ) Notice: Subject to any disclaimer, the term of this patent is extended or adjusted under 35 U.S.C. 154(b) by 315 days.

(21) Appl. No.: 14/555,110

(22) Filed: Nov. 26, 2014

(65) Prior Publication Data

US 2015/0145153 A1 May 28, 2015

Related U.S. Application Data

(60) Provisional application No. 61/908,947, filed on Nov. 26, 2013.

(51) Int. Cl.
*F24F 6/18* (2006.01)
*F24F 13/02* (2006.01)

(52) U.S. Cl.
CPC ..... *F24F 6/18* (2013.01); *F24F 13/0218* (2013.01); *F24F 13/0236* (2013.01)

(58) Field of Classification Search
CPC ..... F24F 13/0209; F24F 6/18; F24F 13/0218; F01F 3/04808
See application file for complete search history.

(56) References Cited

U.S. PATENT DOCUMENTS

| | | | | |
|---|---|---|---|---|
| 903,150 | A | 11/1908 | Braemer | |
| 1,101,902 | A | 6/1914 | Braemer | |
| 1,333,855 | A | 3/1920 | Lissauer | |
| 2,091,265 | A * | 8/1937 | Brown | E21F 1/04 138/107 |
| 2,963,284 | A | 2/1957 | Brandford | |
| 2,939,378 | A * | 6/1960 | Zalkind | B08B 15/02 454/63 |
| 3,084,373 | A | 4/1963 | Beusman | |

(Continued)

FOREIGN PATENT DOCUMENTS

| | | |
|---|---|---|
| CN | 2472061 Y | 1/2002 |
| DE | 25 29 057 | 2/1977 |

(Continued)

OTHER PUBLICATIONS

"A Polymer Alternative to Stainless Steel Trim" Applicant Design published Mar. 1, 2002 accessed at <http://www.appliancedesign.com/articles/84147-a-polymer-alternative-to-stainless-steel-trim>.*

(Continued)

*Primary Examiner* — Amber R Orlando
*Assistant Examiner* — Stephen Hobson
(74) *Attorney, Agent, or Firm* — Merchant & Gould P.C.

(57) ABSTRACT

A steam dispersion system for building humidification is disclosed. At least a portion of the steam dispersion system is comprised of a flexible material that is collapsible for changing the outer dimension of the portion comprised of the flexible material from a greater, higher-pressure, size, to a smaller, lower-pressure, size.

8 Claims, 10 Drawing Sheets

(56) References Cited

U.S. PATENT DOCUMENTS 3,096,817 A * 7/1963 McKenna ..... F24F 6/18 165/60
3,101,209 A * 8/1963 Jorgenson ..... F16L 33/04 138/109
3,215,416 A 11/1965 Liben
3,228,456 A * 1/1966 Brown ..... F22B 1/08 165/134.1
3,268,435 A 8/1966 Sellin
3,333,747 A 8/1967 Glover, Jr.
3,385,485 A 5/1968 Aloi
3,386,659 A 6/1968 Rea
3,443,559 A 5/1969 Pollick
3,486,697 A 12/1969 Fraser
3,623,547 A 11/1971 Wallans
3,632,041 A 1/1972 Radford et al.
3,635,210 A 1/1972 Morrow
3,642,201 A 2/1972 Potchen
3,696,861 A 10/1972 Webb
3,724,180 A 4/1973 Morton et al.
3,727,811 A 4/1973 Buckley
3,747,333 A * 7/1973 Gerstmann ..... F01K 13/006 137/341
3,768,290 A 10/1973 Zatell
3,857,514 A 12/1974 Clifton
3,870,484 A 3/1975 Berg
3,923,483 A 12/1975 Hilmer et al.
3,955,909 A 5/1976 Craig et al.
4,040,479 A 8/1977 Campbell et al.
RE30,077 E 8/1979 Kun et al.
4,257,389 A 3/1981 Texidor et al.
4,265,840 A 5/1981 Bähler
4,271,900 A * 6/1981 Reitz ..... F28F 21/062 165/162
4,384,873 A 5/1983 Herr
D269,808 S 7/1983 Morton
4,438,807 A 3/1984 Mathur et al.
4,660,630 A 4/1987 Cunningham et al.
4,765,058 A 8/1988 Zohler
4,858,681 A * 8/1989 Sulzberger ..... F17D 5/04 165/158
4,913,856 A 4/1990 Morton
4,967,728 A 11/1990 Dueck
5,054,548 A 10/1991 Zohler
5,062,145 A 10/1991 Zwaan et al.
5,126,080 A * 6/1992 Morton ..... F24F 6/18 122/488
5,146,979 A 9/1992 Zohler
5,186,252 A 2/1993 Nishizawa et al.
5,277,849 A 1/1994 Morton et al.
5,313,550 A * 5/1994 Crosnier ..... F24F 6/18 392/325
5,333,682 A 8/1994 Liu et al.
5,372,753 A * 12/1994 Morton ..... F24F 6/18 261/118
5,376,312 A 12/1994 Morton et al.
5,505,385 A * 4/1996 Gengler ..... D01H 11/00 239/553.3
5,516,466 A 5/1996 Schlesch et al.
5,525,268 A 6/1996 Reens
5,543,090 A 8/1996 Morton et al.
5,655,963 A * 8/1997 Paschke ..... F24F 13/068 454/297
5,697,430 A 12/1997 Thors et al.
5,769,708 A * 6/1998 Paschke ..... F24F 13/06 454/296
5,782,689 A * 7/1998 Woolsey ..... F24F 13/068 454/296
5,860,279 A 1/1999 Bronicki et al.
5,942,163 A 8/1999 Robinson et al.
5,996,686 A 12/1999 Thors et al.
6,065,740 A 5/2000 Morton
6,092,794 A 7/2000 Reens
6,167,950 B1 1/2001 Gupte et al.
6,201,223 B1 3/2001 Nitta
6,227,526 B1 5/2001 Morton
6,280,320 B1 * 8/2001 Paschke ..... F24F 13/0218 454/296
6,371,058 B1 4/2002 Tung
6,378,562 B1 4/2002 Noone et al.
6,398,196 B1 6/2002 Light et al.
6,425,417 B1 * 7/2002 Paschke ..... F24F 13/0218 138/106
6,485,537 B2 11/2002 Brilmaker
6,488,219 B1 12/2002 Herr
6,565,430 B2 * 5/2003 Gebke ..... F16L 11/02 454/296
6,631,856 B2 10/2003 Herr
6,669,177 B2 12/2003 Shimanuki et al.
6,824,127 B2 11/2004 Park et al.
6,877,510 B2 * 4/2005 Nitta ..... A61M 16/16 128/203.17
6,883,597 B2 4/2005 Thors et al.
7,048,958 B2 5/2006 de Jong et al.
7,150,100 B2 12/2006 Tase et al.
7,178,361 B2 2/2007 Thors et al.
7,254,964 B2 8/2007 Thors et al.
7,395,588 B2 7/2008 Taniguchi et al.
7,588,029 B2 * 9/2009 Smith ..... A61M 16/08 128/203.17
7,744,068 B2 6/2010 Lundgreen et al.
7,980,535 B2 7/2011 Dovich et al.
8,092,729 B2 1/2012 Lundgreen et al.
8,104,748 B2 * 1/2012 Leister ..... B01D 53/22 261/97
8,534,346 B1 * 9/2013 Mecozzi ..... F28F 9/001 165/54
8,985,158 B2 * 3/2015 Adams ..... E02B 3/108 138/107
2001/0045674 A1 11/2001 Herr
2002/0024155 A1 * 2/2002 Kusano ..... F24F 6/04 261/104
2002/0036020 A1 * 3/2002 Noone ..... B32B 1/08 138/137
2002/0089075 A1 7/2002 Light et al.
2002/0163092 A1 11/2002 Park et al.
2004/0026539 A1 * 2/2004 Herr ..... D21F 7/008 239/533.13
2004/0182855 A1 9/2004 Centanni
2005/0126215 A1 6/2005 Thors et al.
2005/0212152 A1 9/2005 Reens
2005/0282488 A1 * 12/2005 Gebke ..... F16L 11/02 454/306
2006/0024484 A1 * 2/2006 Kendrick ..... B32B 5/02 428/292.1
2006/0042057 A1 3/2006 Taniguchi et al.
2006/0196449 A1 9/2006 Mockry et al.
2008/0290533 A1 11/2008 Dovich et al.
2009/0121367 A1 5/2009 Lundgreen et al.
2009/0166018 A1 * 7/2009 Lundgreen ..... F28F 13/187 165/173
2009/0179337 A1 * 7/2009 Lundgreen ..... F24F 6/18 261/115
2010/0251548 A1 * 10/2010 Lundgreen ..... F24F 6/18 29/890.142
2010/0308480 A1 12/2010 Suzuki
2012/0031601 A1 * 2/2012 Matter, III ..... F28D 1/05383 165/177
2012/0085438 A1 4/2012 Nalini et al.
2012/0125472 A1 * 5/2012 Pinkalla ..... F16L 11/02 138/96 R
2013/0127076 A1 5/2013 Lundgreen et al.
2013/0174439 A1 * 7/2013 Ragosta ..... A45D 20/124 34/283
2014/0202540 A1 * 7/2014 Gebke ..... F16L 11/02 137/1
2016/0377313 A1 * 12/2016 Leiterman ..... F24F 13/0236 454/296
2017/0006737 A1 * 1/2017 Gardner ..... H05K 7/20745
2017/0030608 A1 * 2/2017 Prihoda ..... F24F 13/0218
2017/0159966 A1 * 6/2017 Pinkalla ..... F24F 13/0218
2018/0058714 A1 * 3/2018 Prihoda ..... F24F 13/0218

(56) References Cited

U.S. PATENT DOCUMENTS

FOREIGN PATENT DOCUMENTS

| | | | |
|---|---|---|---|
| DE | 19812476 | | 10/2002 |
| FR | 2663111 | A1 * | 6/1990 |
| FR | 2 846 732 | A1 | 5/2004 |
| GB | 1 444 992 | | 10/1972 |
| WO | WO 00/57112 | | 9/2000 |
| WO | WO 2007/099299 | | 9/2007 |

OTHER PUBLICATIONS

International Search Report and Written Opinion for PCT/US2014/067659 dated Mar. 10, 2015.
NORTEC Inc., Web Page, SAM-e—Short Absorption Manifold—Submitted Drawings, Printed May 21, 2007, pp. 1-26.
TLV Principal Applications for Steam, Aug. 2014, 2 page, Cont © d: @ www.tlv.com/global/TI/steam-theory/principal-applications-for-steam.html.
Wolverine Tube, Inc.—Product Catalog—"Enhanced Surface Tube"—[online]—downloaded Oct. 4, 2007, pp. 1-2, http://www.wlv.com/products/products/Enhanced/enhanced.htm.
Wolverine Tube, Inc.—Turbo-ELP—"ID/OD Enhanced Surface for Improved Boiling Heat Transfer"—[online]—downloaded Nov. 13, 2008, pp. 1-3, http://www.wlv.com/products/products/Enhanced/TurboELP.htm.
ZOTEFOAMS Inc., ZOTEK® F—High Performance PVDF Foams (For Buildings and Construction)—"Taking foam technology to a new level," Oct. 15, 2009, pp. 1-2.
ZOTEFOAMS Inc., ZOTEK® F—High Performance PVDF Foams (For Aviation and Aerospace)—"Taking foam technology to a new level," Oct. 15, 2009, pp. 1-4.
ZOTEFOAMS Inc., ZOTEK® F—High Performance PVDF Foams—"Taking foam technology to a new level," Oct. 15, 2009, pp. 1-4.
ZOTEFOAMS Inc., ZOTEK® F—High Performance PVDF Foams (New Light Weight Materials—Inspiration for Design Innovation)—"Taking foam technology to a new level," Date Printed: Dec. 23, 2008, pp. 1-6.

* cited by examiner

STEAM DISPERSION SYSTEM

CROSS REFERENCE TO RELATED APPLICATIONS

The present application claims priority to U.S. Provisional Application Ser. No. 61/908,947, filed on Nov. 26, 2013, which application is hereby incorporated by reference in its entirety.

TECHNICAL FIELD

The principles disclosed herein relate generally to the field of steam dispersion humidification. Particularly, the disclosure relates to a system that utilizes flexible materials in the construction of the steam dispersion components such as the tubes and headers.

BACKGROUND

In steam dispersion, either pressurized steam from a boiler or un-pressurized steam from an atmospheric steam generator is often used to humidify spaces within buildings. The steam is piped to a steam dispersion device which distributes the steam into an air duct, air handling unit (AHU) or open space. According to a conventional system, the steam dispersion device may consist of a manifold (referred to as a header) to which may be attached a row of stainless steel tubes.

Steam is normally discharged from a steam source as dry gas or vapor. When steam enters a steam dispersion system and mixes with cooler duct air, condensation takes place in the form of water particles. Within a certain distance, the water particles become absorbed by the air stream within the duct. The distance wherein water particles are completely absorbed is called absorption distance. Alternatively, there is the distance wherein water particles or droplets no longer form on duct equipment (except high efficiency air filters, for example). This is known as the non-wetting distance. Absorption distance is typically longer than non-wetting distance. Before the water particles are absorbed into the air within the non-wetting distance and ultimately the absorption distance, the water particles collect on duct equipment. The collection of water particles may adversely affect the life of such equipment. Thus, a short non-wetting or absorption distance is desirable.

To achieve a short non-wetting or absorption distance, steam dispersion systems may utilize multiple, closely spaced, stainless steel, dispersion tubes. The number of tubes and their space are based on needed non-wetting or absorption distance. The dispersion tubes can get very hot (e.g., around 212° F. on outer surface). When a large number of tubes get hot, they heat the surrounding duct air. This ultimately reduces the effect of the cooling and humidification process, thus resulting in wasted energy. Moreover, cool air (e.g. at 50-70° F.) that flows around the hot dispersion tubes causes a portion of the steam within the dispersion tubes to condense and form condensate. The condensate is often drained out of the steam dispersion system, thus wasting water. Stainless steel tubes are conventionally perforated with holes or provided with nozzles to prevent condensate from exiting (spitting). Moreover, perforated tubes may be better at evenly distributing steam to promote rapid absorption into the air.

However, even perforating stainless steel tubes cannot combat many of the disadvantages associated with a typical steam dispersion device. Cool air flowing across the hot dispersion tubes still causes some steam to condense within the dispersion tubes, which is drained out of the device and exits the AHU, wasting water. The dispersion system still heats the air, increasing cooling costs. Static air pressure drop across the dispersion device is always a problem, increasing fan horsepower year round, even when the dispersion device is not used. Rigid stainless steel tubes, headers, and frames may be costly from both a material and shipping perspective. Insulation may be added to the dispersion tubes to reduce condensate and heat gain, however, leading to increased costs and static air pressure drop.

The contradiction that is always present in steam dispersion systems is that short absorption distances require more dispersion tubes, thus creating more condensate, heat gain, and static air pressure drop and designing a system that reduces condensate, heat gain, and static air pressure drop requires the use of fewer tubes, which, however, lead to longer absorption distances.

What is needed in the art is a steam dispersion device that will simultaneously provide short absorption distances, reduced condensate, reduced heat gain and static air pressure drop while achieving a reduction in material, storage, shipping, handling, and installation costs.

SUMMARY

The principles disclosed herein relate to a steam dispersion system that utilizes flexible materials in the construction of steam dispersion components such as tubes, headers, and frame.

According to one particular aspect, the materials from which the steam dispersion components are constructed may be non-metallic materials such as polymeric materials.

According to another particular aspect, the materials from which the steam dispersion components are constructed may be fabric materials.

According to one particular aspect, the materials may include woven or non-woven materials.

If formed from fabric materials, the fabric materials may be woven or non-woven fabric materials.

It should be noted that even though non-metallic materials may provide certain advantages, the inventive aspects of the disclosure are fully applicable to metallic materials. Certain metallic materials such as metallic fabrics or fabrics that include metallic components may provide the inventive features of the steam dispersion systems discussed herein and are contemplated.

According to one particular aspect, if the material forming the portion of the steam dispersion system is fabric material, the fabric material may be of a characteristic that allows steam to exit through the fibers of the fabric material.

According to another particular aspect, the material that makes up at least a portion of the steam dispersion tube is configured to deflate or collapse in response to drops in steam pressure across the steam dispersion system.

According to another particular aspect, the material making up portions of the steam dispersion system is impermeable to steam but is perforated with apertures through which the steam can exit.

According to another particular aspect, the material is both permeable to steam and is perforated with apertures through which the steam can exit.

According to another particular aspect, the material is impermeable to steam but is perforated with apertures that can change in cross-dimensional size through which the steam can exit. The cross-dimensional size can increase or decrease in response to changes in the steam load to maintain a constant pressure within the dispersion system.

According to another particular aspect, the flexible material forming at least a portion of the steam dispersion system may be wrapped around a reinforcing support structure, which can help the flexible portion maintain its shape regardless of steam pressure within the steam dispersion system. A portion of the steam that condenses may wet the flexible material and wick into it. The condensate that has wicked into the flexible material may eventually evaporate into the air.

In other embodiments, the reinforcing support structure may be provided on an outer surface of the portion comprised of the flexible material.

According to another particular aspect, the portions of the steam dispersion system comprised of the flexible material may include the manifold and not just the steam dispersion tubes.

According to another aspect, the disclosure is related to a steam dispersion system comprising at least a portion comprised of a flexible material that is collapsible for changing the outer dimension of the portion comprised of the flexible material from a greater, higher-pressure size to a smaller, lower-pressure, size.

According to another aspect, the disclosure is related to a steam dispersion system comprising at least a portion comprised of a flexible material, wherein the steam dispersion system includes a reinforcing support structure configured to generally maintain the shape of the portion comprised of the flexible material.

According to yet another aspect, the disclosure is related to a steam dispersion system comprising a steam source, a manifold directly communicating with the steam source through a steam conduit, the manifold configured to evenly distribute the steam provided from the steam source, wherein a majority of the manifold is comprised of a non-metallic material.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1A:
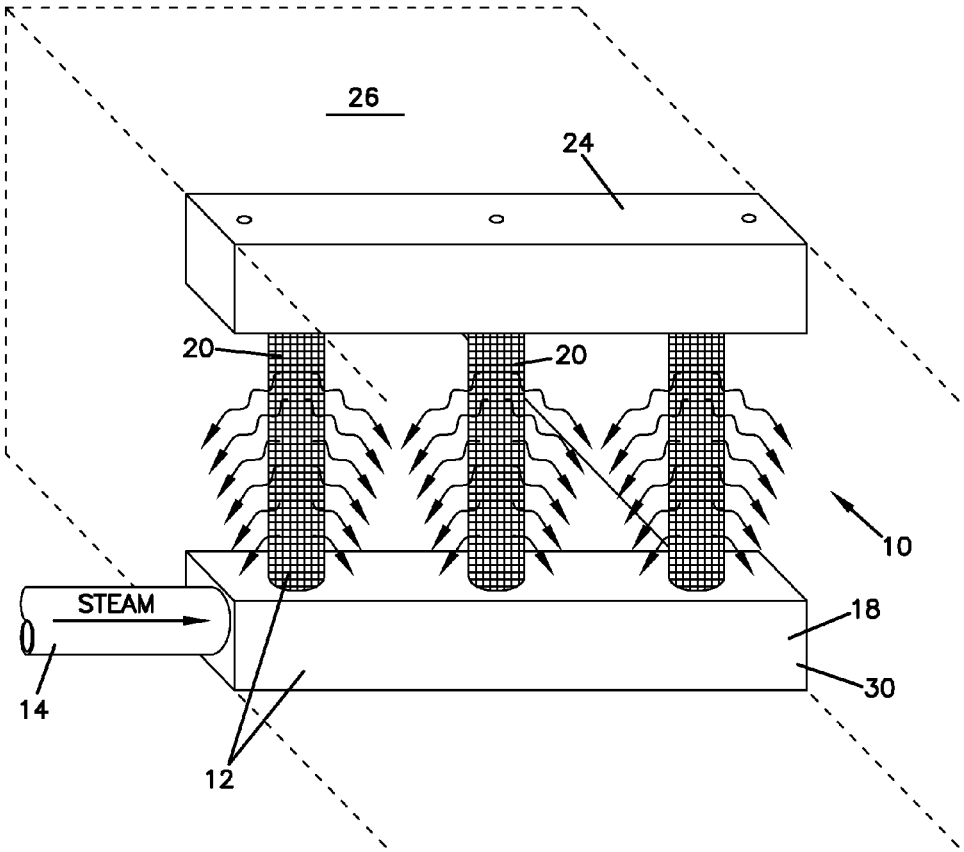
FIG. 1A is a perspective view of an embodiment of a steam dispersion system having features that are examples of inventive aspects in accordance with the principles of the present disclosure, wherein the steam dispersion system includes steam dispersion tubes made from a flexible material.

The principles disclosed herein relate to steam dispersion systems that utilize flexible materials in the construction of steam dispersion components such as tubes, headers, and frames. According to one particular aspect, the materials from which the steam dispersion components are constructed may be non-metallic materials such as polymeric materials. According to another particular aspect, the materials from which the steam dispersion components are constructed may be fabric materials. According to one particular aspect, the materials may include woven or non-woven materials. If formed from fabric materials, the fabric materials may be woven or non-woven fabric materials. Fabrics may include materials that are produced by knitting, weaving, or felting of fibers. Fabrics may include materials that are non-woven fabrics or fabric-like materials made from long fibers, bonded together by chemical, mechanical, heat or solvent treatment. Fabric materials may include materials such as felt, which is neither woven nor knitted.

For example, using a fabric material, such as polyester, in place of steel to construct a portion of a steam dispersion system presents many advantages. For example, polyester fabric is not as thermally conductive as steel. As a result, less condensate may form and less heat will be lost to air. In fact, testing has shown that polyester fabric dispersion tubes produce less condensate and heat gain than steel tubes and even less than steel tubes that have been insulated with materials such as polyvinylidene fluoride fluoropolymer ("PVDF"). Furthermore, as steam enters a fabric steam dispersion system, a portion of the steam that condenses will wet the fabric and wick into it. The remainder of the steam exits through the pores of the fabric membrane. The condensate that has wicked into the fabric will eventually evaporate into the air. Since the fabric membrane is uniformly permeable to air, the steam can exit evenly and with more contact than what a limited quantity perforation can provide. Thus, a fabric steam dispersion system may not only be more energy efficient than a steel constructed component (due to a reduction in condensate and heat loss) but the permeable fabric membrane is likely to result in shorter absorption distances. Testing has shown that the spaces between the fibers in the fabric essentially function as hundreds or thousands of apertures per square inch of fabric for dispersion of steam.

There are additional advantages that fabric or flexible materials present when compared to conventional rigid stainless steel steam dispersion systems. The rigidity of steel results in a system whereby static air pressure drops across the dispersion tube. This necessitates the need for constant fan horsepower, even when not humidifying. In contrast, the fabric material may be flexible and may provide the ability to collapse or deflate the component when steam pressure drops, reducing the system's obstruction to airflow and thus reducing the fan horsepower.

Furthermore, materials such as fabric materials can be manufactured into various shapes outside of the conventional, cylindrical tubes that are formed by conventional manufacturing techniques. Fabric materials can be manufactured into shapes that optimize steam dispersion as will be described in further detail below. Thus, a fabric based steam dispersion system can optimize steam dispersion while also minimizing static air pressure drops.

Furthermore, materials such as fabric materials may be much more cost efficient alternative to metals such as stainless steel generally costing only a fraction of the price. Additionally, fabric materials generally weigh much less and can be collapsed, folded, or rolled to minimize size and volume of the overall component. This allows for convenient storing, handling, and shipping. Installation costs may also potentially be reduced. In sharp contrast, rigid metal based components such as stainless steel tubes, headers, and frames may be more expensive and difficult to store, handle, and transport because of their weight and size.

It should be noted that even though non-metallic materials may provide certain advantages as noted above, the inventive aspects of the disclosure are fully applicable to metallic materials. Certain metallic materials such as metallic fabrics or fabrics that include metallic components or fibers may provide the advantages discussed above with respect to the inventive aspects of the steam dispersion systems discussed herein. Metallic materials that may provide the flexibility, the permeability, or the lack of thermal conductivity desired for the steam dispersion systems of the present disclosure are certainly contemplated.

Figure 1B:
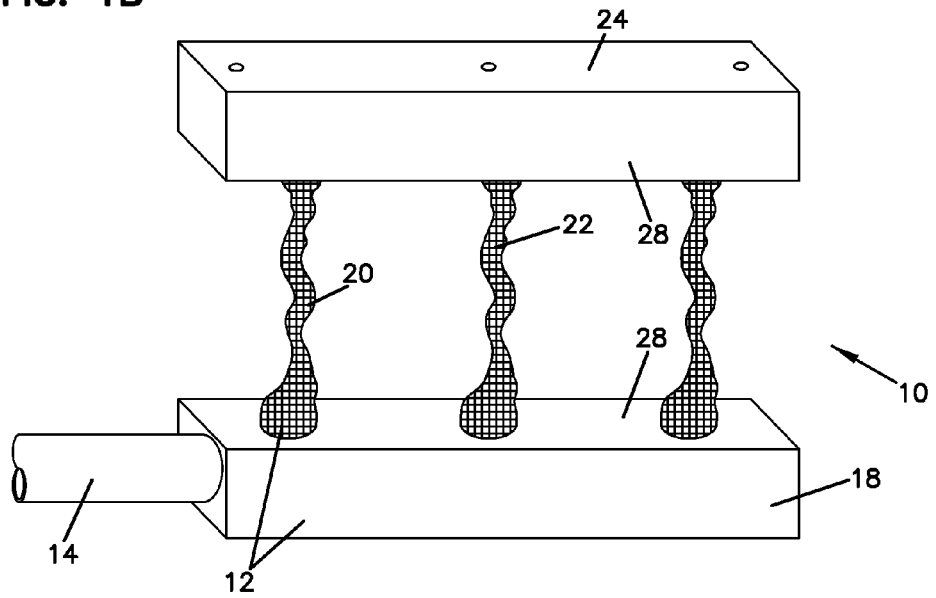
FIG. 1B illustrates the steam dispersion system of FIG. 1A with the steam dispersion tubes in a deflated configuration due to lack of steam pressure.

An embodiment of a steam dispersion system 10 having features that are examples of inventive aspects in accordance with the principles of the present disclosure is illustrated in FIGS. 1A-1B.

In the depicted embodiment, the steam dispersion system 10 includes a steam dispersion apparatus 12 configured to receive humidification steam from a steam source 14. The steam dispersion apparatus 12 shown includes a plurality of steam dispersion tubes 20 extending from a steam manifold 18. In the embodiment shown, the steam dispersion apparatus 12 includes three steam dispersion tubes 20 extending out of the manifold 18, wherein at least portions of the steam dispersion tubes 20 comprise of a flexible material 22 as discussed above. The steam dispersion tubes 20 extend between the manifold 18 and a bracket 24 that may be used to mount the tubes 20 in a duct 26. The manifold 18, along with the bracket 24, may define a frame 28 of the steam dispersion system 10. It should be noted that the steam dispersion tubes 20 may be mounted to the air duct 26 in other various ways.

The steam source 14 may be a boiler or another steam source such as an electric or gas humidifier. The steam source 14 provides pressurized steam towards the manifold 18 of the steam dispersion apparatus 12. In the depicted example, each of the tubes 20 communicates with the manifold 18 for receiving pressurized steam. The steam tubes 20, in turn, disperse the steam to the atmosphere at atmospheric pressure. In the embodiment illustrated in FIGS. 1A-1B, the manifold 18 is depicted as a header 30, which is a manifold designed to distribute pressure evenly among the tubes protruding therefrom.

In a system such as that illustrated in FIGS. 1A-1B, the steam supplied by the steam source 14 is piped through the system 10 at a pressure generally higher than atmospheric pressure, which is normally the pressure at the point where the steam exits the header 30 and meets duct air. The pressure created by the flowing steam within the tubes 20 causes the steam dispersion tubes 20 to inflate and take a tubular shape, as illustrated in the examples depicted in FIGS. 1A, 2A, 3A, and 4A.

Figure 2A:
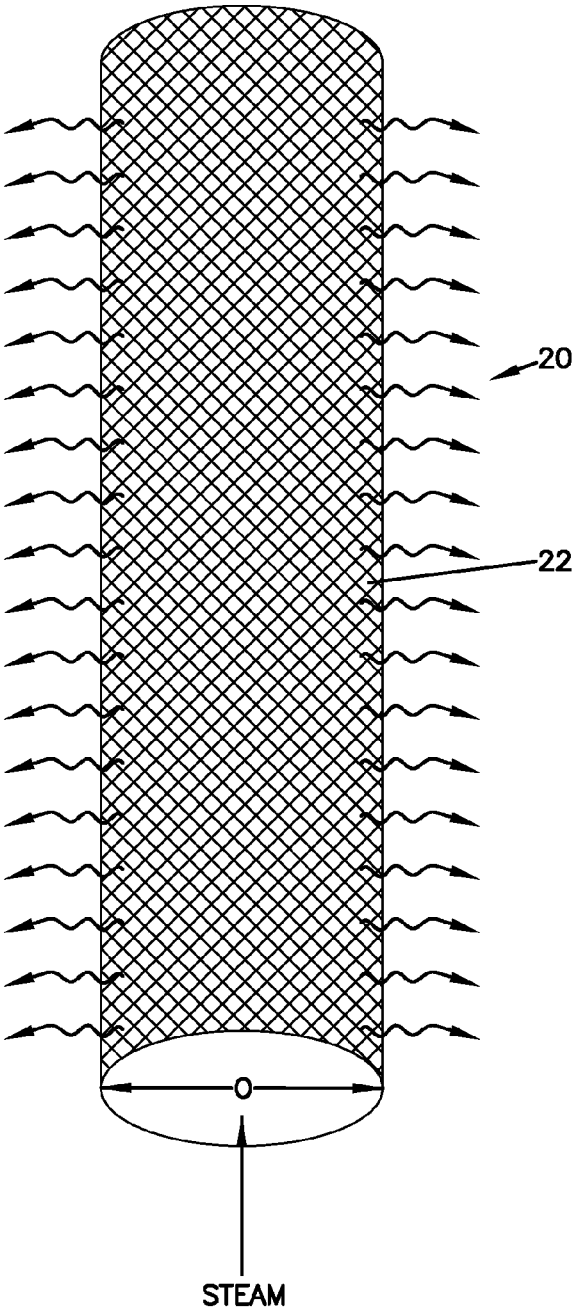
FIG. 2A is a close-up perspective view of one of the steam dispersion tubes in FIG. 1A, wherein the steam dispersion tube is illustrated in an inflated configuration.

If the flexible material is a fabric material or a fiber-based material, the steam can exit the steam dispersion tubes 20 through tiny pores 32 defined between the fibers of the material 22, as illustrated in FIG. 2A.

When the flow of steam is ceased, leading to reduced pressure inside the tubes 20, the material 22 of the tubes 20 is configured to deflate/collapse. Thus, the flexible portions of the tubes 20 are configured as collapsible structures wherein the outer dimension O thereof can change from a greater, higher-pressure, size, to a smaller, lower-pressure, size. FIG. 1B illustrate the tubes 20 in a collapsed condition.

Figure 2B:
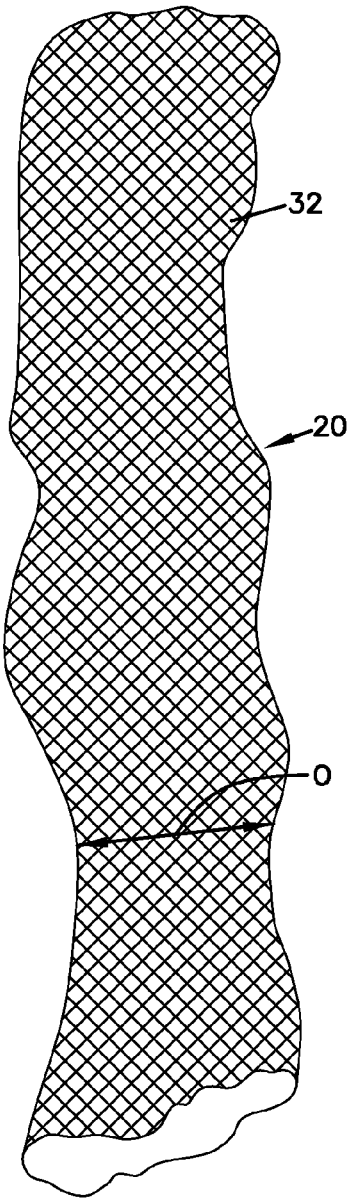
FIG. 2B is a close-up perspective view of the steam dispersion tube of FIG. 2B, with the tube shown in a deflated configuration.

Now referring to FIGS. 2A-2B, a close-up perspective view of one of the steam dispersion tubes 20 in FIG. 1A is illustrated. In FIG. 2A, the steam dispersion tube 20 is illustrated in an inflated configuration and in FIG. 2B, the tube 20 is shown in a deflated configuration. The version of the tube 20 illustrated in FIGS. 2A-2B is permeable to steam. In the depicted embodiment, the flexible material is a fabric material that defines pores 32 between the fibers making up the fabric material 22.

Figure 3A:
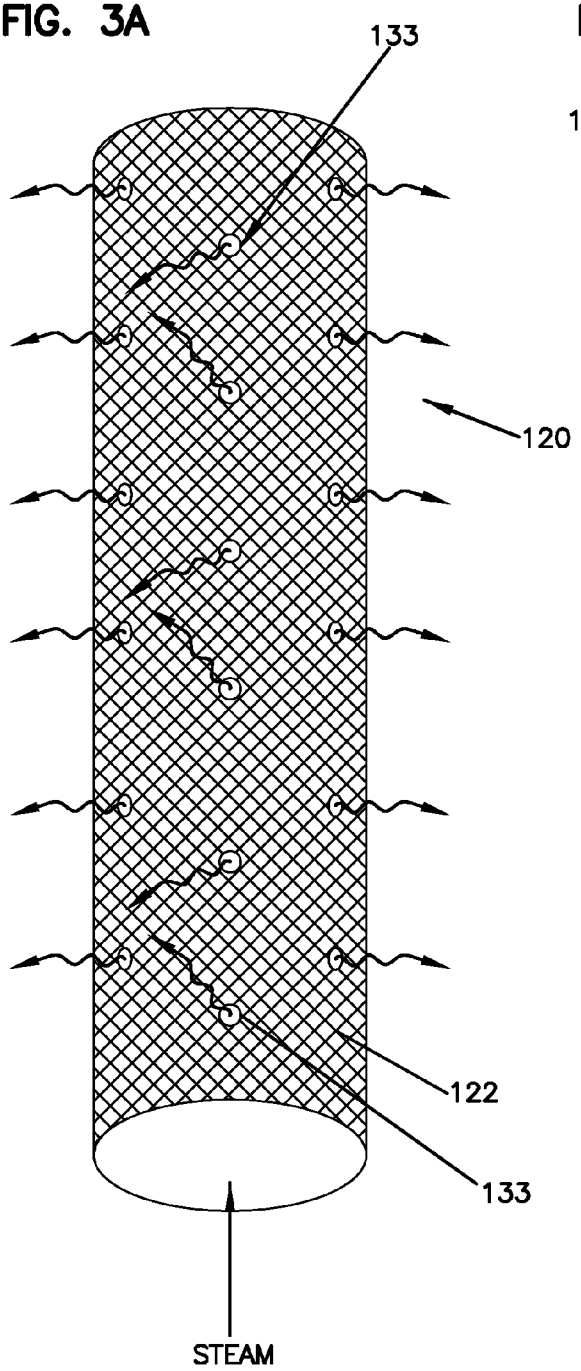
FIG. 3A is a close-up perspective view of another embodiment of a steam dispersion tube configured for use with the system shown in FIGS. 1A-1B, the tube shown in an inflated configuration, wherein the material of the tube is impermeable to steam but includes a plurality of apertures for exiting the steam therefrom.
Figure 3B:
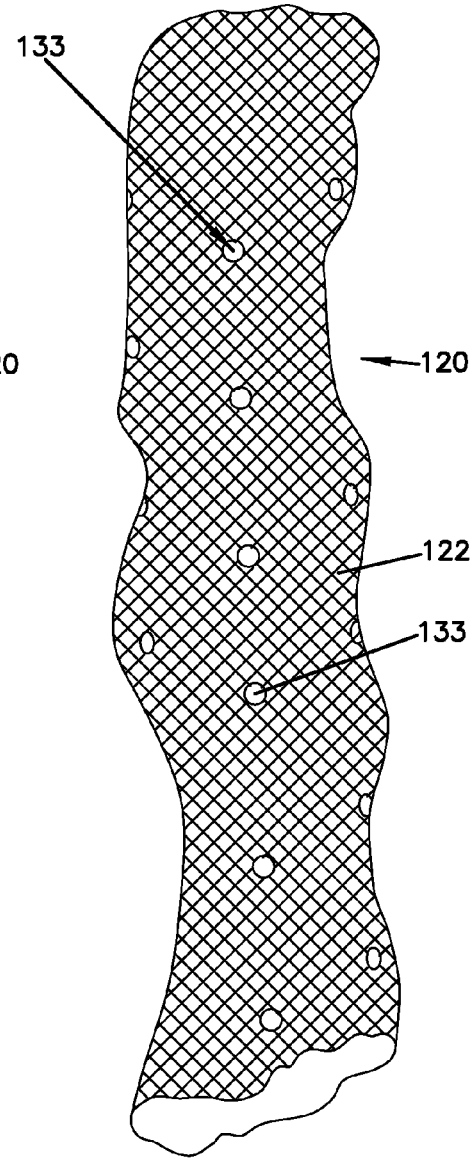
FIG. 3B illustrates the steam dispersion tube of FIG. 3A in a deflated configuration.

FIGS. 3A-3B illustrate a close-up perspective view of yet another steam dispersion tube 120 usable with the system 10 illustrated in FIGS. 1A-1B, wherein the material 122 of the tube is impermeable to steam. The tube 120 includes a plurality of apertures 133 formed in the material 122 for exiting the steam. In this manner, the tube 120 still provides the advantage of collapsibility when the pressure is reduced.

Figure 4A:
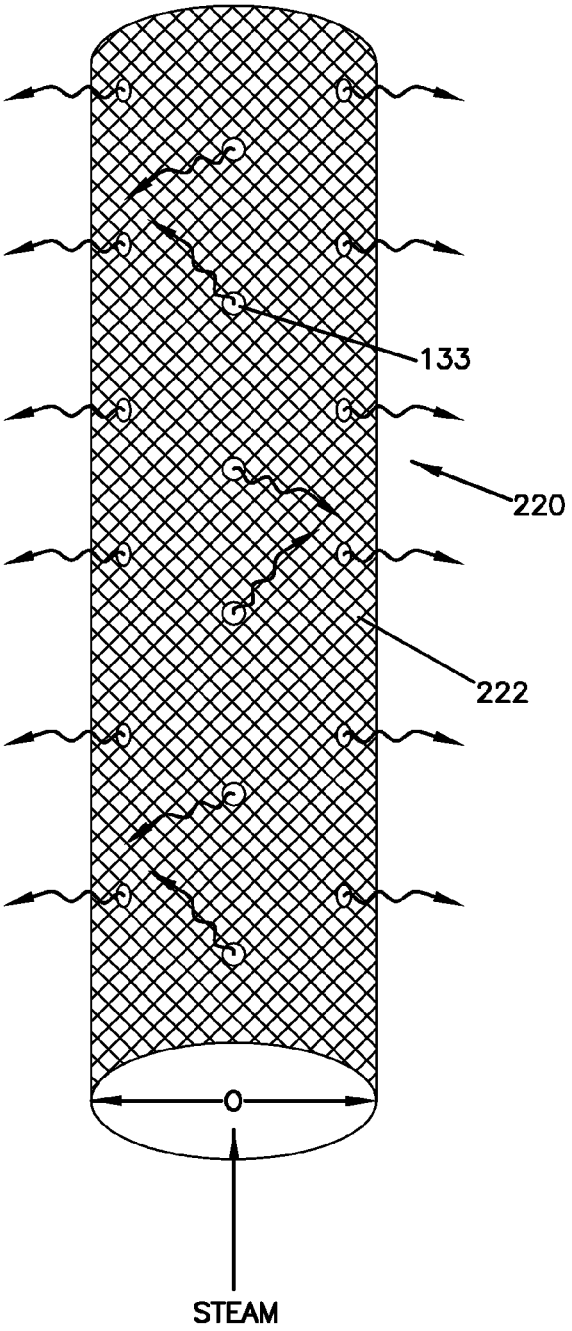
FIG. 4A is a close-up perspective view of yet another embodiment of a steam dispersion tube configured for use with the system shown in FIGS. 1A-1B, the tube shown in an inflated configuration, wherein the material of the tube is permeable to steam and also includes a plurality of apertures for exiting the steam therefrom.
Figure 4B:
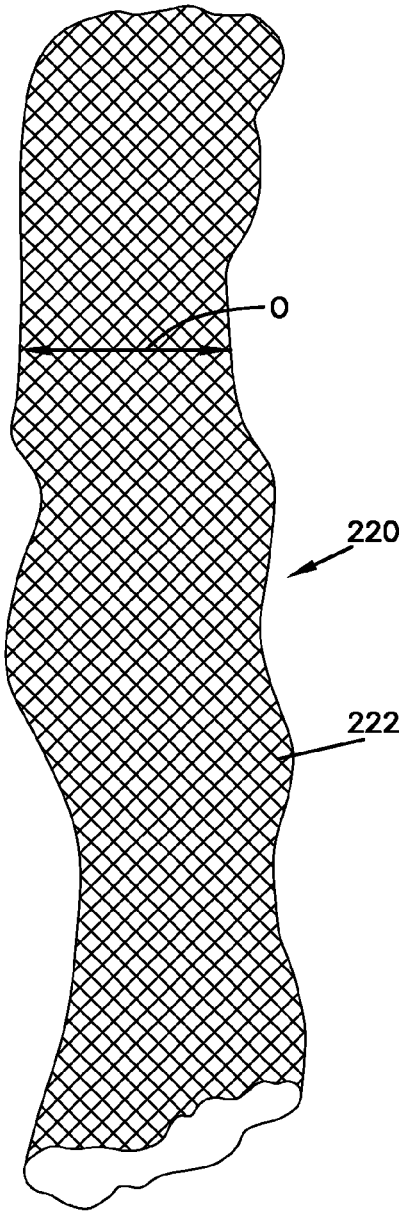
FIG. 4B illustrates the steam dispersion tube of FIG. 4A in a deflated configuration.

FIGS. 4A-4B illustrate a close-up perspective view of yet another steam dispersion tube 220 usable with the system 10 illustrated in FIGS. 1A and 1B, wherein the material 222 of the tube is permeable to steam and also includes a plurality of apertures 133 similar to the version of the tube 120 shown in FIGS. 3A-3B. Similar to the tubes 20, 120 shown in FIGS. 2A, 2B, 3A, and 3B, the tube 220 shown in FIGS. 4A-4B is collapsible for changing the outer dimension O of the portion of the tube 220 comprised of the material 222 from a greater, higher-pressure, size, to a smaller, lower-pressure, size.

Figure 5A:
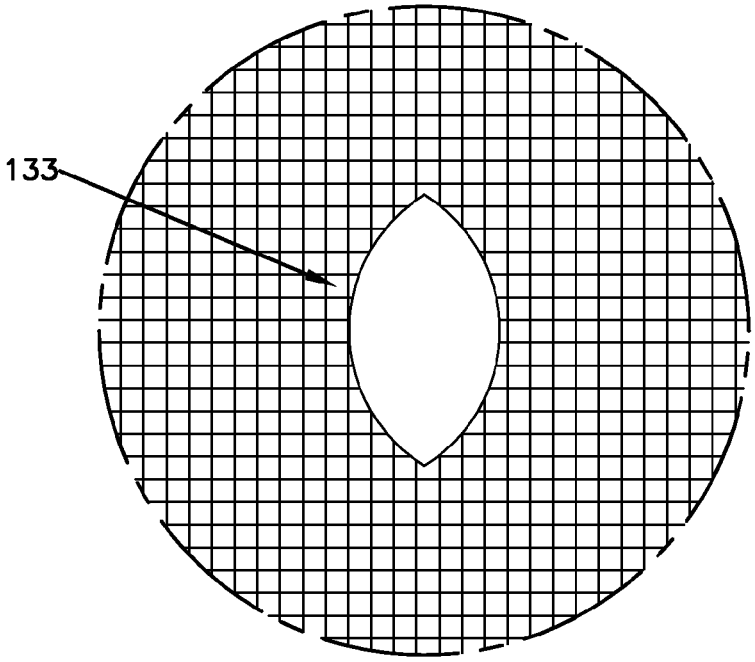
FIG. 5A is a close-up perspective view of one of the apertures shown in FIGS. 3A, 3B, 4A, wherein the apertures can change in cross-dimensional size in response to steam pressure, the aperture shown in a higher-pressure condition.
Figure 5B:
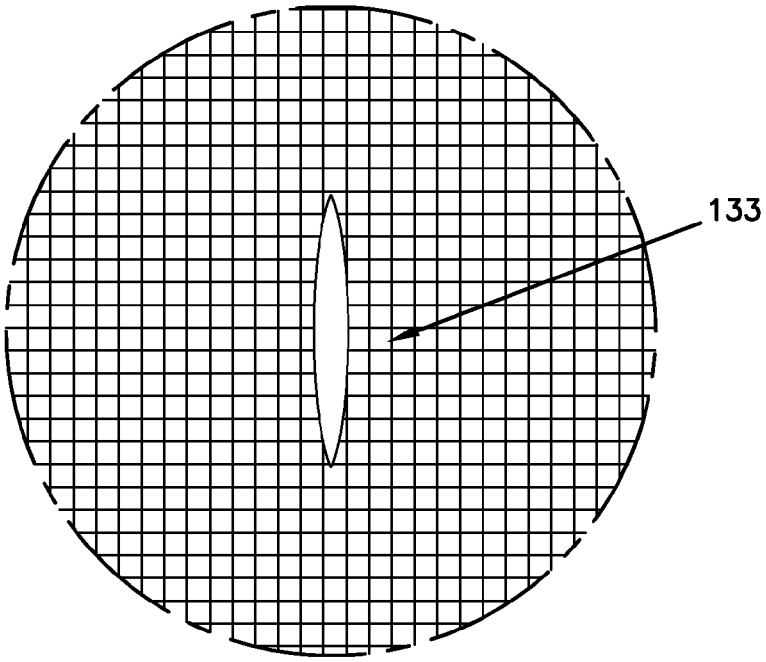
FIG. 5B illustrates the aperture of FIG. 5A in a lower-pressure condition.

FIGS. 5A and 5B illustrate close-up perspective views of one of the apertures 133 in FIGS. 3A, 3B, 4A, wherein the apertures 133 are configured to change in cross-dimensional size in response to steam pressure. In FIG. 5A, the aperture 133 is shown in a higher-pressure condition and FIG. 5B illustrates the aperture 133 in a lower-pressure condition. The variability of the cross-dimensional size of the apertures 133 may accommodate a larger range of steam loads.

Figure 6:
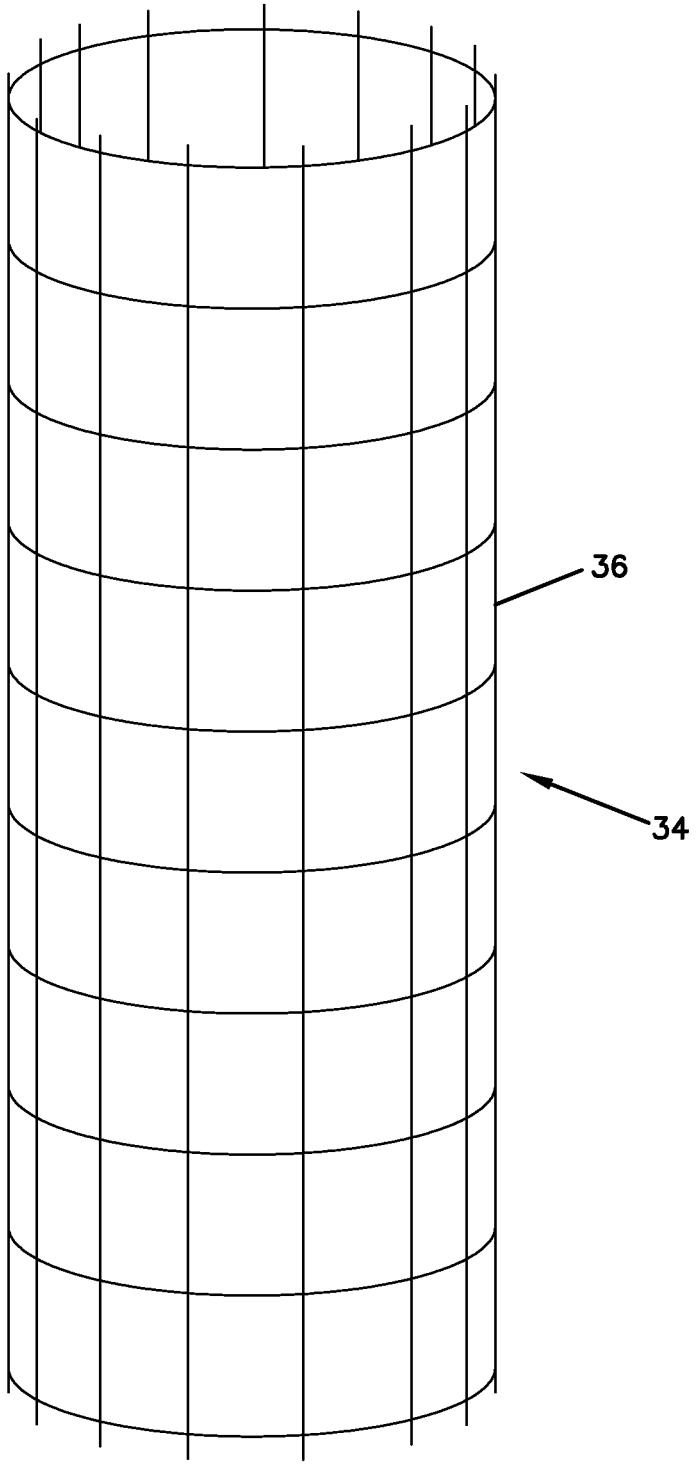
FIG. 6 is a perspective view of a reinforcing support structure that may be used to support one of the steam dispersion tubes used in the system of FIGS. 1A-1B, wherein the reinforcing support structure is configured to generally maintain the shape of the steam dispersion tube and wherein the reinforcing support structure may be used within the steam dispersion tube or on the exterior of the steam dispersion tube.

In certain embodiments, it might be useful to provide rigidity for the portions of the steam dispersion system 10 that are comprised of flexible materials and not allow for collapsibility. FIG. 6 is a perspective view of a reinforcing support structure 34 that may be used to support one of the steam dispersion tubes 20, 120, 220 used in the system 10 of FIGS. 1A-1B, wherein the reinforcing support structure 34 is configured to generally maintain the shape of the flexible steam dispersion tube and wherein the reinforcing support structure 34 may be used within the steam dispersion tube or on the exterior of the steam dispersion tube. In the version illustrated in FIG. 6, the reinforcing support structure 34 is defined by a metallic mesh 36 having a generally open skeletal structure so as to not interfere with the steam dispersion properties of the flexible material. The metallic mesh 36 may be a structure that is removable from the flexible portion of the steam dispersion tube 20, 120, 220. In this manner, the flexible material may still be collapsible for storage or transport reasons and the mesh 36 provided during the mounting of the flexible portion to an air duct 26.

As noted above, in certain embodiments, the portion of the steam dispersion system comprised of the non-metallic material such as the steam dispersion tube 20, 120, 220 may surround the reinforcement support structure 34. In other embodiments, the reinforcing support structure 34 may surround the portion of the steam dispersion tube comprised of the flexible material. For example, in a steam dispersion tube 20, 120, 220 that defines an inner face 38 and an outer face 40 wherein the steam flows from the inner face 38 toward the outer face 40, the reinforcing support structure 34 may surround the outer face 40.

It should be understood that in yet other embodiments wherein rigidity of the steam dispersion structures is desired, the fabric or non-metallic material of the dispersion system 10 may be rigid enough itself to define the reinforcing support structure and may retain its shape even during a low-pressure condition. Such materials may still be collapsible under a load for storage and transport reasons. However, they may be designed to retain their shape when mounted in an HVAC environment such as an air duct 26 and under operating pressures.

Figure 7:
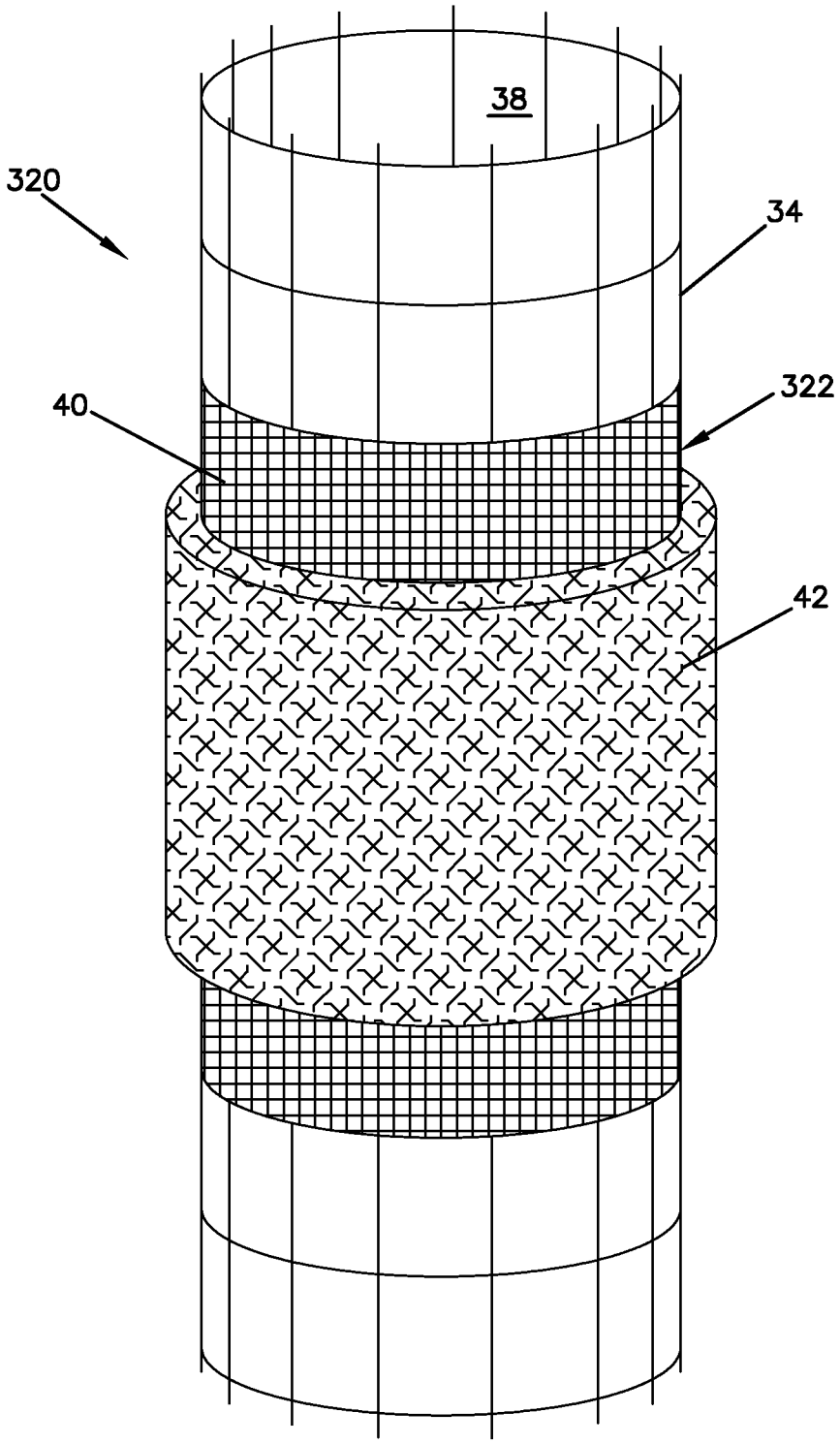
FIG. 7 is a perspective view of yet another steam dispersion tube configured for use with the system shown in FIGS. 1A-1B, wherein the flexible material of the steam dispersion tube is supported with an internally located reinforcing support structure and also includes a wicking material surrounding the tube.

FIG. 7 illustrates another embodiment of a steam dispersion tube 320 configured for use with the system 10 shown in FIGS. 1A-1B. In the version in FIG. 7, the material 322 of the steam dispersion tube is supported with an internally located reinforcing support structure 34 and also includes a wicking material 42 surrounding portion 322 of the tube 320. As noted above, as steam enters the steam dispersion system, a portion of the steam that condenses will tend to wet the non-metallic material 322 and wick into it. The remainder of the steam exits through the pores 332 of the membrane 322. The condensate that has wicked into the material 322 will eventually evaporate into the air. The wicking material 42 surrounding material 322 facilitates this process. An example of a wicking material 43 could be swamp cooler media.

Figure 8:
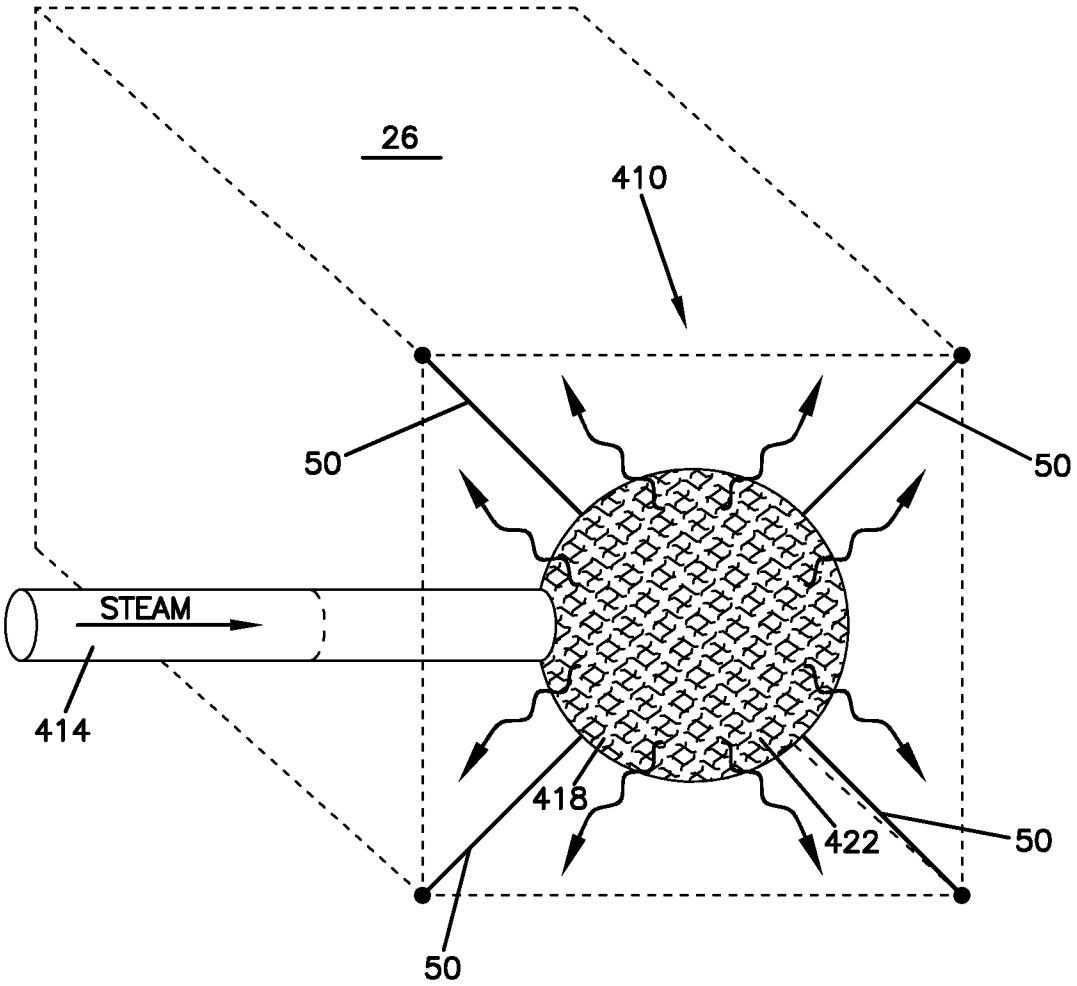
FIG. 8 is a perspective view of another embodiment of a steam dispersion system having features that are examples of inventive aspects in accordance with the principles of the present disclosure, wherein the steam dispersion system includes a manifold defining a spherical shape having at least a portion comprised of a flexible, fabric, or non-metallic material, wherein the manifold communicates directly with a steam source, the manifold configured to evenly distribute the steam provided from the steam source.
Figure 9:
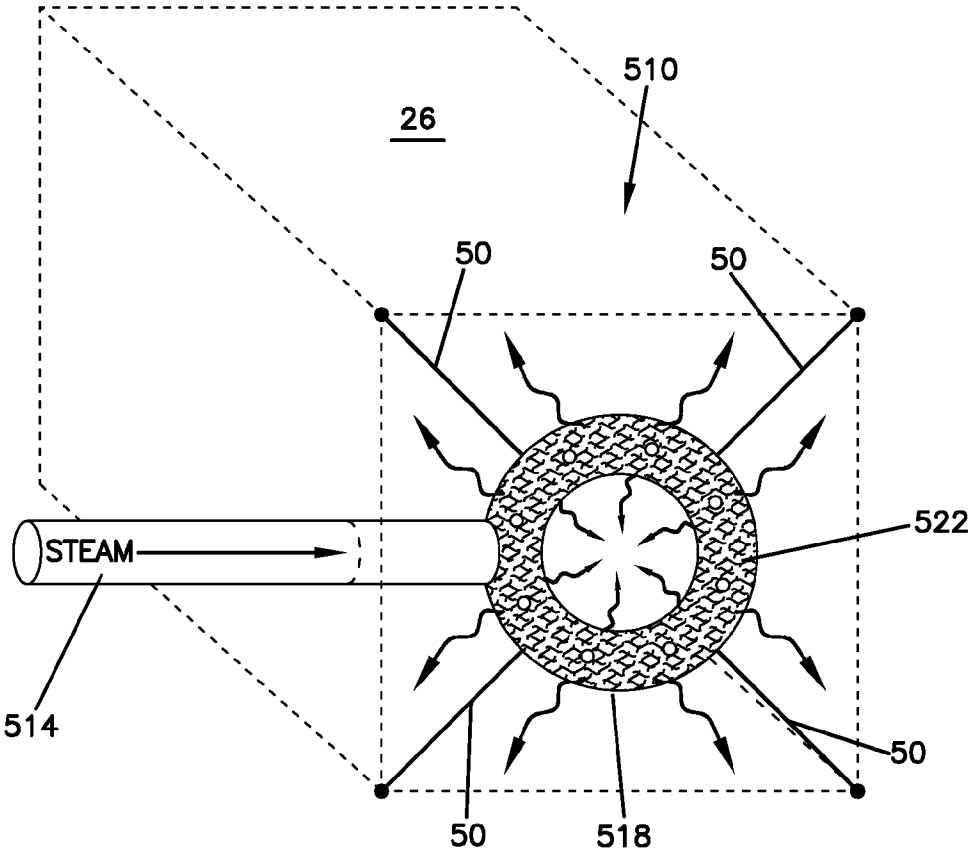
FIG. 9 is a perspective view of another embodiment of a steam dispersion system having features that are examples of inventive aspects in accordance with the principles of the present disclosure, wherein the steam dispersion system includes a manifold defining a cylindrical ring shape having at least a portion comprised of flexible, fabric, or non-metallic material, wherein the manifold communicates directly with a steam source, the manifold configured to evenly distribute the steam provided from the steam source.
Figure 10:
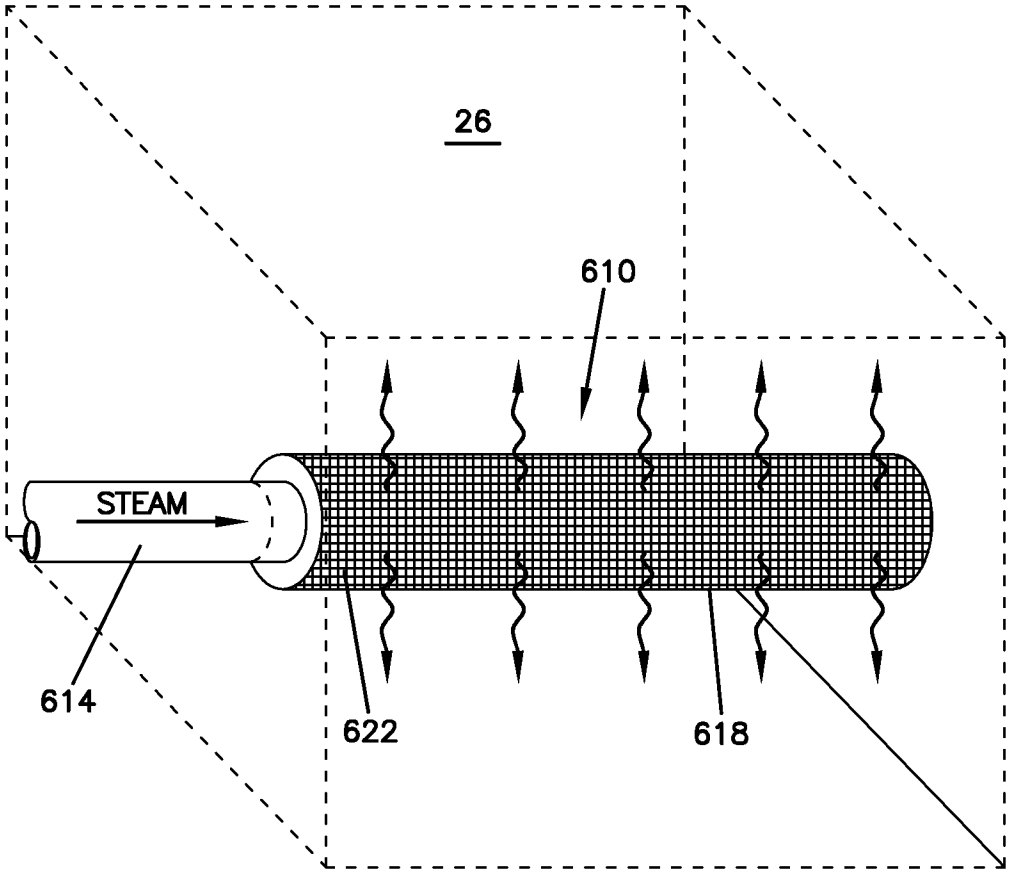
FIG. 10 is a perspective view of another embodiment of a steam dispersion system having features that are examples of inventive aspects in accordance with the principles of the present disclosure, wherein the steam dispersion system includes a manifold defining a tubular shape having at least a portion comprised of flexible, fabric, or non-metallic material, wherein the manifold communicates directly with a steam source and does not include a steam dispersion tube extending therefrom, the manifold configured to evenly distribute the steam provided from the steam source.

Referring now to FIGS. 8-10, although in the previous examples of steam dispersion systems 10, only the steam dispersion tubes 20, 120, 220, 320 of the system 10 are shown to be comprised of flexible, fabric, or non-metallic materials, in other embodiments, such materials can be used to construct essentially the entire steam dispersion system. For example, according to certain embodiments, a manifold that communicates directly with the steam source, such as a header, may be constructed from a flexible, a fabric (e.g., non-metallic or metallic), or a non-metallic material wherein steam dispersion would occur through the material without the need for additional tubes extending from the header. According to certain embodiments, a majority of the manifold may be comprised of such a material.

The material that may be used on any portion of a steam carrying apparatus or system may be permeable to steam (with or without additional apertures larger than those defined by fibers of a fabric if the material is a fibrous material) or impermeable to steam with additional apertures.

And, although in the FIG. 7, a wicking type material 42 has been shown to be used only on a steam dispersion tube, the wicking material 42 can be included on other portions of the steam dispersion system, such as the header. The wicking material 42 can be provided on any portion of any steam carrying apparatus or system.

FIG. 8 is a perspective view of an embodiment of a steam dispersion system 410 having features that are examples of inventive aspects in accordance with the principles of the present disclosure, wherein the steam dispersion system 410 includes a manifold 418 defining a spherical shape having at least a portion comprised of a fabric (e.g., non-metallic or metallic), a flexible, or a non-metallic material 422, wherein the manifold 418 communicates directly with a steam source 414. The spherical shape of the manifold 418 is configured to evenly distribute the steam provided from the steam source 414. In the example embodiment, the spherical shaped manifold may be attached to the air duct 26 via cables 50. Other attachment methods are possible.

FIG. 9 is a perspective view of another embodiment of a steam dispersion system 510 having features that are examples of inventive aspects in accordance with the principles of the present disclosure, wherein the steam dispersion system 510 includes a manifold 518 defining a cylindrical ring shape having at least a portion comprised of a material 522 similar to material 422 discussed above. The ring shape of the manifold 518 is configured to evenly distribute the steam provided from the steam source 514. The ring shaped manifold 518 can also be attached to the air duct 26 via cables 50.

FIG. 10 is a perspective view of another embodiment of a steam dispersion system 610 having features that are examples of inventive aspects in accordance with the principles of the present disclosure, wherein the steam dispersion system 610 includes a conventional tubular type manifold design 618 extending across the air duct 26. However, in the embodiment shown in FIG. 10, unlike a conventional header that might extend across an air duct 26 and support a plurality of tubes, the manifold 618 does not include a steam dispersion tube extending therefrom and is comprised of a material 622 similar to materials 422, 522 to evenly distribute the steam provided from the steam source 614. The tubular manifold 618 may extend horizontally or vertically within the air duct 26 and may be attached to the walls of the air duct 26 via various means known in the art.

It should be noted that the portions of the steam dispersion systems supplying steam to the manifolds of the illustrated systems may include one or more steam sources. For example, the humidification steam supplied to the manifolds may be generated by a boiler or an electric or gas humidifier which operates under low pressure (e.g., less than 1 psi). In other embodiments, the humidification steam supplied to the manifolds may be operated at higher pressures, such as between about 2 psi and 60 psi. In other embodiments, the humidification steam source may be run at higher than 60 psi. As noted above, the humidification steam that is inside the manifold is normally at about atmospheric pressure at the point the steam is exposed to the duct air.

The above specification, examples and data provide a complete description of the inventive features of the disclosure. Many embodiments of the disclosure can be made without departing from the spirit and scope thereof.

The invention claimed is:

1. A steam dispersion system for building humidification, the steam dispersion system comprising:

a steam header configured to receive humidification steam from a steam source and a plurality of steam dispersion tubes extending from the steam header, wherein the steam header and the plurality of steam dispersion tubes are configured to be mounted in an air duct, the steam header defining a header interior, the steam dispersion tubes defining tube interiors in direct fluid communication with the header interior such that humidification steam flows through the header interior to the tube interiors and exits the tube interiors through steam delivery points, each of the plurality of steam dispersion tubes defining at least a portion comprised of a flexible material that is collapsible for changing the outer dimension of the portion comprised of the flexible material from a greater, higher-pressure size to a smaller, lower-pressure size when the humidification steam is not flowing through the tube interior, wherein the flexible material is permeable to steam so as to define the steam delivery points for delivering the humidification steam into the air duct, wherein the flexible material is a fabric material.

2. A steam dispersion system according to claim 1, wherein the flexible material is a metallic material.

3. A steam dispersion system according to claim 1, wherein the flexible material is a non-metallic material.

4. A steam dispersion system according to claim 3, wherein the non-metallic material is a polymeric material.

5. A steam dispersion system for building humidification, the steam dispersion system comprising:

at least one steam dispersion tube for delivering humidification steam from a steam source to an air duct through a plurality of steam delivery points of the tube, the at least one steam dispersion tube defining at least a portion comprised of a flexible material that is collapsible for changing the portion comprised of the flexible material from a greater, higher-pressure size to a smaller, lower-pressure size when the humidification steam is not flowing through the steam dispersion tube, wherein the flexible material is permeable to steam so as to define the steam delivery points for delivering the humidification steam into the air duct, wherein the flexible material is a fabric material.

6. A steam dispersion system according to claim 5, wherein the flexible material is a metallic material.

7. A steam dispersion system according to claim 5, wherein the flexible material is a non-metallic material.

8. A steam dispersion system according to claim 7, wherein the non-metallic material is a polymeric material.

* * * * *